United States Patent [19]

Kobayashi

[11] Patent Number: 5,056,456

[45] Date of Patent: Oct. 15, 1991

[54] AUTOMATICALLY OPENED AND CLOSED BARREL

[76] Inventor: Takashi Kobayashi, 60-4, Aza Susaki, Oaza Saijo, Oharu-cho, Aichi-ken Ama-gun, Japan

[21] Appl. No.: 416,326

[22] Filed: Oct. 2, 1989

[30] Foreign Application Priority Data

Jul. 21, 1989 [JP] Japan ..... 1-189257

[51] Int. Cl.[5] ..... B05C 3/08; C25D 17/20

[52] U.S. Cl. ..... 118/418; 118/500; 204/213

[58] Field of Search ..... 118/416, 418, 500, 19; 204/201, 213

[56] References Cited

U.S. PATENT DOCUMENTS

| | | | |
|---|---|---|---|
| 3,583,739 | 6/1971 | Gill | 204/213 |
| 3,861,654 | 1/1975 | Singleton | 204/213 |
| 3,934,548 | 1/1976 | Kaluza | 118/418 |
| 4,014,774 | 3/1977 | Noonan | 118/418 |
| 4,543,906 | 10/1985 | Glatt et al. | 118/19 |
| 4,753,255 | 6/1988 | Melin | 118/418 |

*Primary Examiner*—Michael Wityshyn

*Attorney, Agent, or Firm*—Wenderoth, Lind & Ponack

[57] ABSTRACT

An automatically opened and closed barrel is disclosed for use in plating treatments, chemical conversion coating treatments, etc. This barrel is provided with an opening and closing cam having a groove at a top part thereof and a slidable supplementary plate which covers the groove of the cam. A lid is pivoted relative to the barrel for covering an opening therein. A lever is fixed for pivotal movement with the lid, and only when the lid is required to be opened, the supplementary plate is slid so as to expose the groove in the cam. When this occurs, a free end of the lever is dropped into the groove of the cam such that the lid uncovers the barrel opening. The lever is prevented from dropping into the groove of the cam at every rotation of the barrel because the supplementary plate covers the groove at the cam which it is unnecessary to have the barrel opening uncovered, with the result of a longer usable life of the barrel.

12 Claims, 3 Drawing Sheets

AUTOMATICALLY OPENED AND CLOSED BARREL

BACKGROUND OF THE INVENTION

This invention relates to an automatically opened and closed barrel for use in plating, chemical conversion coating, etc. This barrel is so designed that a lid is opened only when the barrel must be kept open, otherwise the lid is kept closed.

Generally, barrels are used for a plating treatment. The barrel for a plating treatment has an opening through which material to be treated is put in and treated material is taken out. This opening is provided with a lid by which it is closed. This lid is of either screw type or lever type. Whenever material to be treated is put in or treated material is taken out, a screw or a lever is loosened for opening the lid and later is tightened for closing the lid. Thus, the lid opening and closing operation must be done manually and such manual operation is troublesome.

In order to improve the opening and closing operation of a lid of a barrel, the present applicant previously devised a barrel having a lid which is automatically opened and closed and applied to the Japanese Patent Office for a patent for such device. This patent application was published in the Official Patent Gazette (Japanese Utility Model Registration Application Publication No. 54-14728). This automatic lid opening and closing device for a barrel is characterized in that a lid is hinged to one of the edges of the opening of a barrel in such a fashion that it swings only within the barrel itself and a lever is provided at a hinge shaft. This lever is worked by a guide bar in response to the normal or the reverse rotation of a barrel for keeping the lid in a closed state or in an opened state. Thus, material to be treated can be put in or treated material can be taken out of the barrel, without the necessity of hands, and various treatments can be carried out continuously and automatically.

In the case where the automatically opened and closed barrel mentioned above is used for a plating treatment, Applicant's previously devised barrel is completely suitable. However, it has recently been suggested to use barrels for a chemical conversion coating treatment of parts, for example, as well as plating treatments. As compared with the parts for which a plating treatment is given, parts of machine tools and others are larger in size and heavier in weight. At present, in the case of the chemical conversion treatment, material to be treated is put in a cage having an opening at the top surface thereof and the cage is hung down or hung up by a hoist crane or the like into or from a treating liquid tank. Mere immersing of a cage containing material to be treated in a treating liquid tank does not give a uniform chemical conversion treatment to the outer surface of the parts, especially when the parts are of complicated construction. In this connection, it is imaginable that a uniform treatment can be carried out if material to be treated is put in a barrel and the barrel is rotated. However, material to be treated is often heavy in weight, and the barrel which is normally made of synthetic resin when used for a plating treatment is of an inadequate strength. Therefore, it is required to manufacture barrels with chemical resistant metal, such as stainless steel. When the barrel is formed of metal, however, the weight of its lid becomes heavier, and if the construction of a conventional automatic opening and closing type barrel is adopted, the lid will swing at each rotation of the barrel. Consequently a cam for opening and closing the lid and a lever which is slid by such cam will be broken.

SUMMARY OF THE INVENTION

The present invention includes a barrel with a lid, a cam and a lever. The cam and lever are so operated that the lid is opened only at a position of the barrel where material to be treated is taken in or treated material is taken out, and at other positions the lid never opens even if the lever moves along the circumferential surface of the cam.

According to the present invention, the barrel lid is mounted openably and closably at an opening of the barrel. The barrel is rotatable in normal and reverse directions, and the lever which is fixed to and extends from a hinge shaft of the lid and which is so designed that it can extend into a groove formed in an opening and closing cam provided at the side of the barrel upon rotation of the barrel. A supplementary plate is supported, under spring pressure, such that it is slidable between contacting and separating positions relative to the side of the barrel by a support rod which rotatably supports the barrel. The supplementary plate is adapted to cover the groove of the opening and closing cam, and the groove is opened by sliding the supplementary plate. An opening guide, which is spring biased toward the cam, extends toward a taking out stand of the barrel and is operable to slide the supplementary plate in dependence on the vertical position of the barrel.

When the lever is slid along the outer circumferential surface of the opening and closing cam having a groove for opening the lid, owing to the supplementary plate which is so designed as to expose the groove of the opening and closing cam only at the position of the barrel where the lid is to be opened, even when the barrel revolves in a normal direction and the lever slides along the circumferential surface of the opening and closing cam, the groove of the cam is kept covered by the supplementary plate and the lid does not open easily. However, if the barrel is supported by a barrel supporting table, the supplementary plate is slid against the spring pressure due to a guide rail protruding toward the supporting table and the guide bar protruding from the supplementary plate, the groove of the opening and closing cam is exposed and the lever of the lid is slid into the groove. Thus, the lid of the barrel is opened.

By hanging up the barrel from the supporting table, the supplementary plate is automatically forced by spring pressure to cover the groove of the opening and closing cam.

BRIEF DESCRIPTION OF THE DRAWINGS

The nature and advantages of the present invention will be understood more clearly from the following description made with reference to the accompanying drawings, in which.

DETAILED DESCRIPTION OF THE INVENTION

Figure 1:
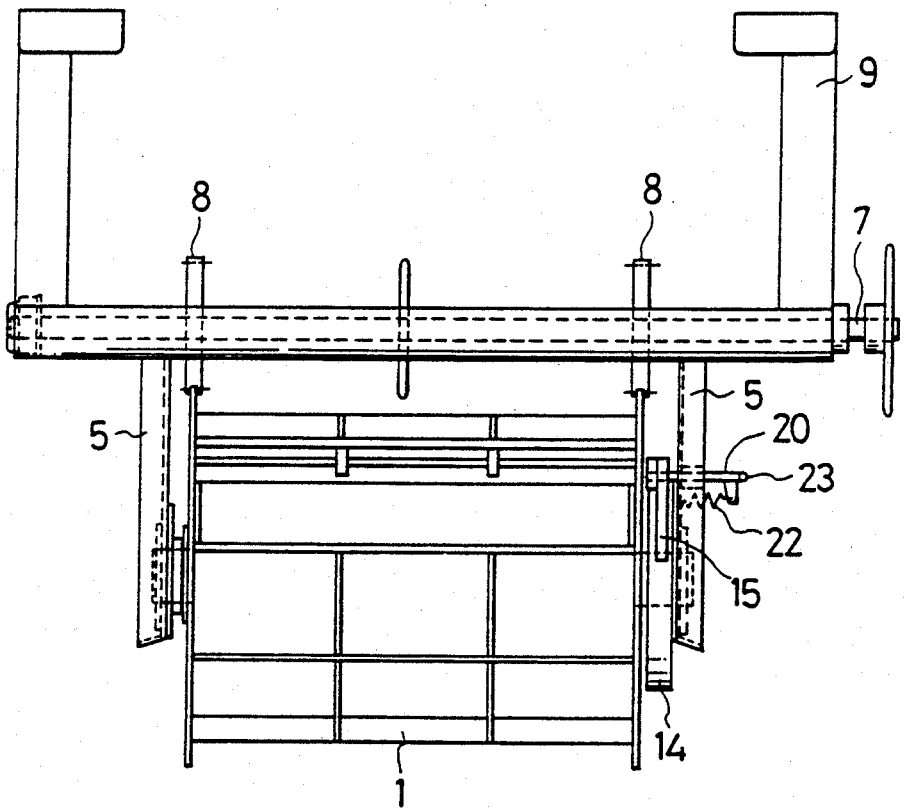
FIG. 1 is a front view of a barrel and supporting frame according to the present invention.
Figure 2:
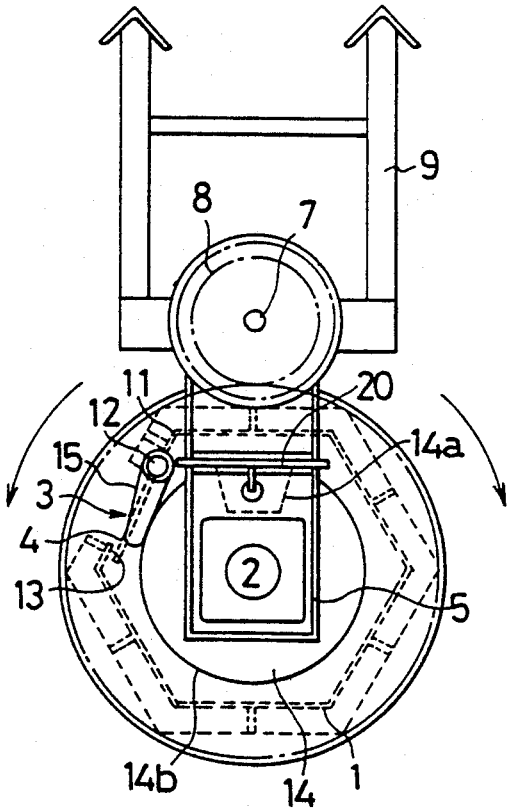
FIG. 2 is a side view of the barrel and frame shown in FIG. 1.
Figure 3:
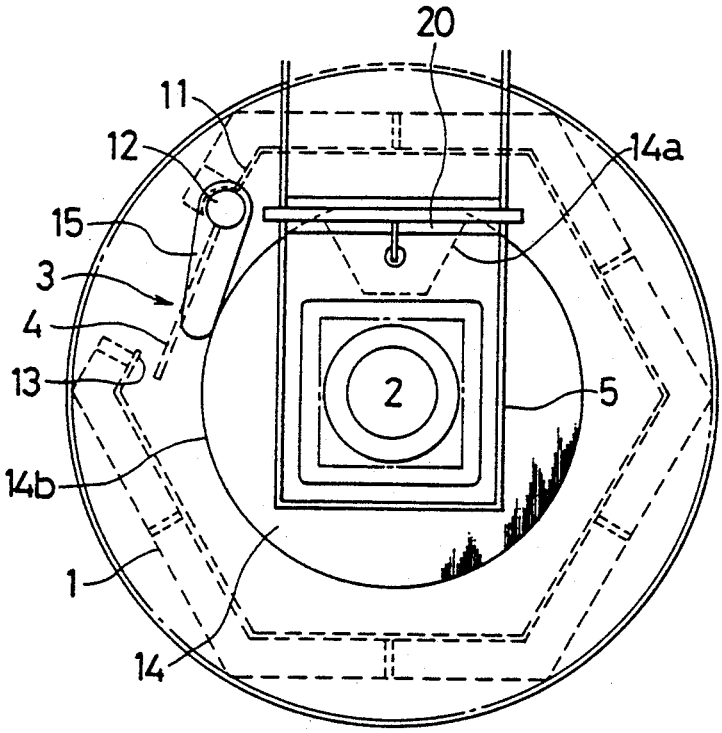
FIG. 3 is a side view, on an enlarged scale, of the barrel of FIG. 2.
Figure 4:
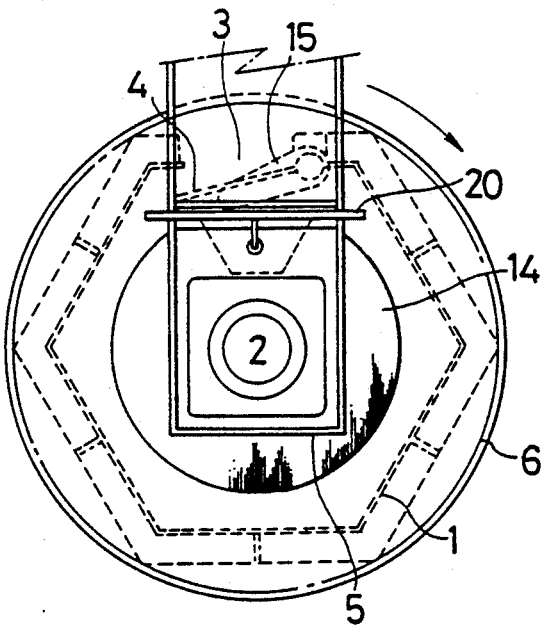
FIG. 4 and FIG. 5 are explanatory drawings showing a side view and a front view, respectively, of a main part of the barrel with its lid closed during turning of barrel in a normal direction.
Figure 5:
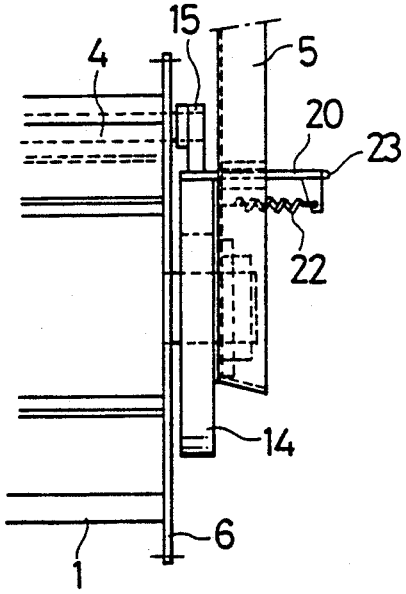

In the drawings, reference numeral 1 designates a barrel. Support shafts 2 on both sides are rotatably supported by support rods 5 so that the barrel is immersed and kept in a treating liquor tank of the desired shape.

The support rods 5 are so adapted as to hang down at the under part of a frame 9. A spur gear 6 is fitted to one of the support shafts 2 or a spur gear is carved directly on the outer circumferential edge of a barrel side plate. A driving spur gear 8 fitted to a driving shaft 7 supported by the frame 9 is engaged with the spur gear 6. By driving the driving shaft 7, the barrel 1 is rotated for carrying out the desired various treatments. The rotation should be either "continuous" or "intermittent". Normal and reverse rotations are done selectively.

The barrel 1 is formed in conventional polygonal cage-like shape. One or more openings 3 are made at a trunk part (circumferential surface) of the barrel 1, and a lid 4 is hinged on the edge of this opening 3 in such a fashion that it swings only within the barrel. More particularly, a hinge shaft 12 is provided along one side of an edge 11 which is in parallel with the axial center of the barrel 1. One side of the lid 4 is fixed to the hinge shaft 12 so that a free end edge of the lid engages with the inside of the other side 13 of the opening 3. In order to make such engagement tighter, an auxiliary bevelled edge piece may be fitted to the hinged edge or the free end edge of the lid so that the bevel can engage a complementary surface on the edge of the opening. Thus, the lid 4 is kept in opened or closed state by its own weight.

The hinge shaft 12 is inserted through a side plate, and a lever 15 is fixed to an end portion of the hinge shaft 12 so that a top end of the lever 15 can contact an opening and closing cam 14 which is fixed to the support rod 5 and is concentric with the barrel 1.

The opening and closing cam 14 is of a disk shape and has a groove **14*a* at the top part thereof so as to allow for rotation of the lever 15. With this construction, the cam 14 can press against the lever 15 with its peripheral portion, so as to cause the lid 4 to be pressed against the periphery of the opening 3 and thereby close the opening 3. Therefore, the size of the groove 14*a* of the disk-like opening and closing cam 14 is so determined that when the lever 15 rotates with the rotation of the barrel and a top end of the lever 15 is fitted in the groove 14*a*, the lid 4 swings about the rotational axis of the hinge shaft 12 so as to open the opening 3 to a predetermined extent. In this state, the lid opens and closes once during each rotation of the barrel 1. Therefore, when the barrel 1 is immersed in a treating liquid tank while it ascends and descends between a plurality of treating liquid tanks, the lid will open and close once per every rotation of the barrel, but it is so adapted that when the barrel is in a position in which the lid should not be opened, even if the free end of the lever reaches the groove 14*a* of the opening and closing cam 14**, the lever does not enter into the groove.

In order to avoid the lid from opening when such is not desired while the barrel 1 is rotating, in the present invention a supplementary plate 20 is provided for the barrel 1. This supplementary plate 20 serves to block the groove **14*a* of the opening and closing cam 14. This supplementary plate 20 is supported horizontally by guide rails 21 provided at the support rod 5. That is, the supplementary plate 20 is supported in such a fashion that it is movable in a direction between a position in which it contacts the cam 14 adjacent the groove 14*a* and a position in which it is separated from the cam 14. By stretching a tension spring 22 between the supplementary plate 20 and the support rod 5, the supplementary plate 20 is always kept at the outer circumferential surface of the cam 14 by the action of the spring 22 and blocks the groove 14*a* of the opening and closing cam 14. Therefore, even when the barrel 1 rotates in this state and the lever 15, which rotates with the rotation of the barrel, slides along the outer peripheral surface of the cam, the lever 15 moves across the supplementary plate 20 which has blocked the groove 14*a*. Thus the lid 4** will not open.

This supplementary plate 20 has a guide bar 23 protruding therefrom. By this guide bar, the supplementary plate 20 is moved against the tension force of the spring 22 and the groove **14*a* of the opening and closing cam 14 is exposed. When this supplementary plate 20 moves horizontally from the position in which it blocks the groove 14*a* at the outer peripheral surface of the opening and closing cam 14, it is in such position that it opens the barrel to put in material to be treated or take out treated material. Therefore, in the treating liquid tank there is no need for moving this supplementary plate 20 and an opening guide 31 protrudes toward a taking out table 30 which supports the barrel at the position where material to be treated is put in or treated material is taken out. This opening guide 31 is slanted at its upper part 31*a* so that when the barrel is hung down to the designated position, the supplementary plate 20 is moved to the predetermined position due to the slanted part 31*a* of the opening guide 31**.

Figure 6:
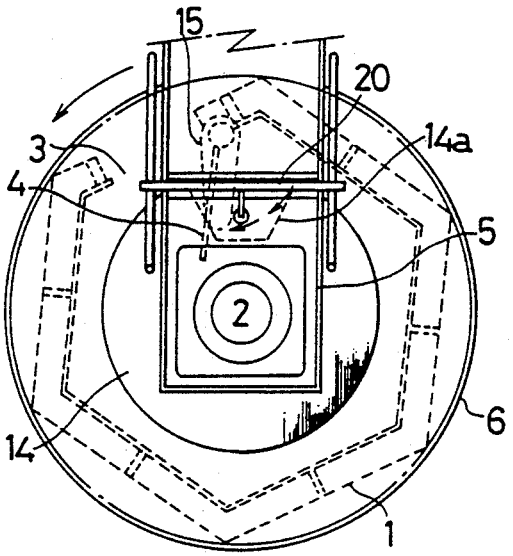
FIG. 6 and FIG. 7 are explanatory drawings similar to FIGS. 4 and 5, respectively, but with the barrel lid opened during turning of the barrel in the reverse direction.
Figure 7:
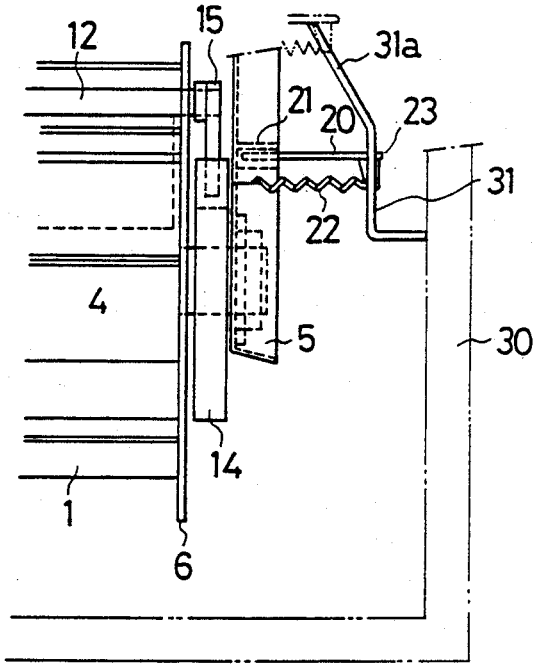
Figure 8A:
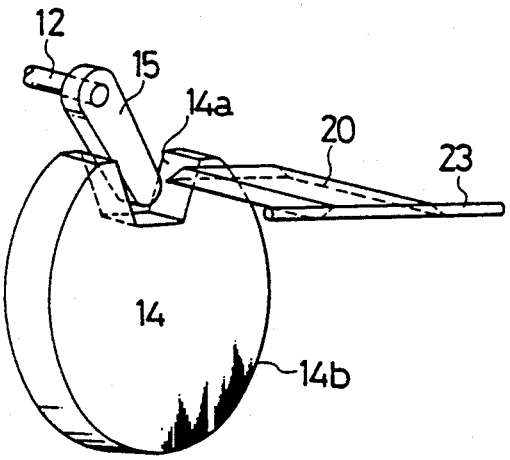
FIG. 8A is an explanatory drawing showing an opening and closing cam and a supplementary plate in a condition in which the lid is open.
Figure 8B:
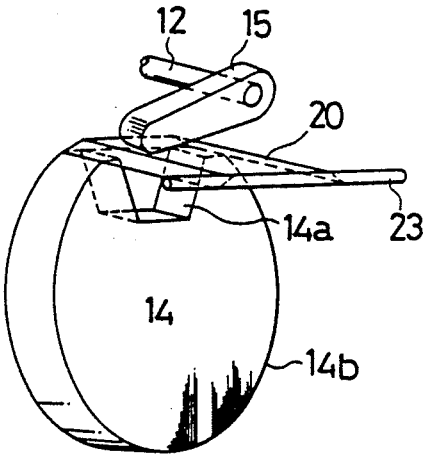
FIG. 8B shows the opening and closing cam and the supplementary plate in a condition in which the lid is closed.

When the barrel 1 containing material which has been given the desired treatment is hung down onto the taking out table 30 having the opening guide 31, the guide bar 23 engages with the slanted part **31*a* of the opening guide 31. When the barrel 1 is further lowered, the guide bar 23 slides along the slanted part 31*a* of the opening guide 31 and the guide bar is moved toward the outer side against the force of the spring 22, whereby the supplementary plate 20 provided integrally with the guide bar 23 is also moved and separates from the groove 14*a* of the opening and closing cam 14, such that the groove 14*a* is exposed. (Refer to FIG. 6 and FIG. 8A). In the state where the supplementary plate 20 has moved and the groove 14*a* of the cam 14 has been exposed, the lowering of the barrel 1 stops and the barrel 1 is supported on the table 30. If the barrel 1 is moved again and the lever 15 encounters the groove 14*a*, the free end of the lever 15 is fitted in the groove 14*a*, namely, the lever 15 swings about the rotational axis of the hinge shaft and the lid 4 is opened. If the barrel 1 is turned in the reverse direction, contrary to the case of treating, the top end of the lever comes off the cut portion 14*a* but the lid maintains its opened state by its own weight and when the opening 3** is rotated downward, treated material is discharged from the barrel.

Material to be treated is discharged when the opening 3 of the barrel is rotated upward.

When the barrel 1 is moved up relative to the table 30, the guide bar 23 moves along the opening guide 31, but when the barrel 1 is moved down, the supplementary plate 20 moves due to action of the tension spring 22 and blocks the groove 14*a* of the opening and closing cam 14.

In Applicant's previous automatic opening and closing barrel, a lever enters into a groove of a cam at each rotation of the barrel and impact is concentrated upon both the cam and the lever, which results in breakage and a reduced life for the components.

In the present invention, a cut portion of the cam is covered with a supplementary plate which is slidable, whereby the groove 14*a* is exposed only when the lid is required to be opened to allow the free end of the lever to drop into the groove of the cam for opening the lid. Therefore, the present invention contributes to prolonging the usable life of the barrel.

I claim:

1. An apparatus for automatically opening and closing a lid pivotably mounted to a barrel to cover an opening in the barrel, the barrel being rotatable, said apparatus comprising:

a lever adapted to be fixed for pivotal movement with the lid;

a cam adapted to be mounted for rotation with the barrel at an end thereof, said cam having a groove formed across a peripheral edge thereof;

a supplementary plate;

support means for rotatably supporting the barrel, and for slidably supporting said supplementary plate for sliding movement relative to said cam between a covering position in which said supplementary plate is adjacent said cam and is adapted to cover said groove formed in said peripheral edge of said cam, and an exposing position in which said supplementary plate is separated from said cam, said support means being adapted to be vertically movable;

spring means for biasing said supplementary plate toward said covering position; and guide means, operatively connected with said support means, for guiding said supplementary plate to move between said covering position as said support means is moved vertically; and guide means, operatively connected with said support means, for guiding said supplementary plate to move between said covering position and said exposing position as said support means is moved vertically.

2. An apparatus as recited in claim 1, wherein said guide means comprises an opening guide fixed against vertical movement such that said support means can move vertically relative thereto.

3. An apparatus as recited in claim 2, wherein said opening guide includes a lower portion which is disposed substantially vertically, and an upper portion which is slanted relative to said lower portion upwardly and inwardly toward said cam.

4. An apparatus as recited in claim 3, further comprising a guide bar extending from said supplementary plate and being operatively connected to said opening guide for vertical sliding motion therealong.

5. An apparatus as recited in claim 1, wherein said cam is substantially disc-shaped, and said groove is substantially shaped as a truncated V.

6. An apparatus comprising:

a barrel having an opening formed therein and being adapted for rotation;

a lid pivotable mounted to said barrel for movement between a position in which said lid covers said opening and a position in which said lid exposes said opening;

a lever fixed for pivotal movement with said lid;

a cam mounted for rotation with said barrel at an end thereof, said cam having a groove formed across a peripheral edge thereof;

a supplementary plate;

support means for rotatably supporting said barrel, and for slidably supporting said supplementary plate for sliding movement relative to said cam between a covering position in which said supplementary plate is adjacent said cam and is adapted to cover said groove formed in said peripheral edge of said cam, and an exposing position in which said supplementary plate is separated from said cam, said support means being adapted to be vertically movable;

spring means for biasing said supplementary plate toward said covering position; and guide means, operatively connected with said support means, for guiding said supplementary plate to move between said covering position and said exposing position as said support means is moved vertically.

7. An apparatus as recited in claim 6, wherein said guide means comprises an opening guide fixed against vertical movement such that said support means can move vertically relative thereto.

8. An apparatus as recited in claim 7, wherein said opening guide includes a lower portion which is disposed substantially vertically, and an upper portion which is slanted relative to said lower portion upwardly and inwardly toward said cam.

9. An apparatus as recited in claim 8, further comprising a guide bar extending from said supplementary plate and being operatively connected to said opening guide for vertical sliding motion therealong.

10. An apparatus as recited in claim 6, wherein said cam is substantially disc-shaped, and said groove is substantially shaped as a truncated V.

11. An apparatus as recited in claim 6, wherein said opening is formed in a circumferential wall of said barrel.

12. An apparatus as recited in claim 11, further comprising a hinge shaft rotatable mounted to said barrel adjacent said opening, said lid and said lever being fixed to and extending radially from said hinge shaft.

* * * * *